US005439141A

United States Patent [19]

Clark et al.

[11] Patent Number: 5,439,141

[45] Date of Patent: Aug. 8, 1995

[54] DUAL LIQUID SPRAYING SYSTEM

[75] Inventors: Gregory Clark, Westport; Stanley I. Mason, Jr., Weston, both of Conn.

[73] Assignee: Scott Paper Company, Delaware County, Pa.

[21] Appl. No.: 278,467

[22] Filed: Jul. 21, 1994

[51] Int. Cl.[6] ..... B67D 5/52

[52] U.S. Cl. ..... 222/136; 222/375; 222/382; 222/383.1; 239/304

[58] Field of Search ..... 222/129, 136, 144.5, 222/145, 375, 376, 382, 383; 239/304, 333

[56] References Cited

U.S. PATENT DOCUMENTS

| | | | |
|---|---|---|---|
| 3,760,986 | 9/1973 | Castner et al. | 222/145 X |
| 3,786,963 | 1/1974 | Metzler, III | 222/136 |
| 4,355,739 | 10/1982 | Vierkötter | 222/136 X |
| 4,361,256 | 11/1982 | Corsette | 222/383 |
| 4,618,077 | 10/1986 | Corsette | 222/383 |
| 5,009,342 | 4/1991 | Lawrence et al. | 222/136 |
| 5,152,431 | 10/1992 | Gardner et al. | 222/136 |
| 5,152,461 | 10/1992 | Proctor | 239/304 |
| 5,332,157 | 7/1994 | Proctor | 222/136 X |
| 5,361,944 | 11/1994 | Hauf et al. | 222/136 |
| 5,370,275 | 12/1994 | Mills et al. | 222/136 |

FOREIGN PATENT DOCUMENTS 443519 8/1991 European Pat. Off. ..... 239/304

OTHER PUBLICATIONS

Calmar Worldwide Brochure (2 sheets) printed in U.S.A. by Calmar Inc. dispensing systems.

*Primary Examiner*—Kevin P. Shaver
*Attorney, Agent, or Firm*—Woodcock, Washburn, Kurtz, Mackiewicz & Norris

[57] ABSTRACT

A manifold for use with a hand held pump spray device allowing the spray head to draw simultaneously from two separate reservoirs containing two different fluids such that the spray heads raise a mixture of the two fluids in a predetermined ratio. The manifold includes at least one ball check valve arrangement in the suction line to the chemical concentrate reservoir, the ball check valve being normally biased to a closed position. The check valve presents the pumping of the concentrate when the diluent reservoir is spent and further prevents cross contamination between the fluids in the two reservoirs due to syphoning.

13 Claims, 6 Drawing Sheets

DUAL LIQUID SPRAYING SYSTEM

BACKGROUND OF THE INVENTION

1. Field of the Invention

The present invention relates generally to spraying devices for spraying liquids from a container, and, more particularly, to hand held spraying devices capable of spraying at least two different fluids simultaneously through a single spray head.

2. Brief Description of the Prior Art

There are numerous hand held spray devices known in the prior art. Most of such spray devices are designed to deliver a single fluid such as a solution of water and a detergent. Also known in the prior art are various hand held spray devices which are designed to deliver mixtures of two or more liquids through a spray head. One such device is taught in U.S. Pat. No. 5,009,342 to Lawrence, et al. The device of Lawrence, et al. utilizes a valve assembly mounted between the compartments containing the two different liquids and the spray pump assembly. The valve assembly includes inner and outer control valve members for controlling the connection of the inlet to the outlet. The control valve members are rotatable relative to one another which allows the size of the inlets to be variable so as to vary the ratio of the two liquids being dispensed.

U.S. Pat. No. 4,355,739 to Vierkötter teaches a container spray head assembly wherein suction is taken from two separate chambers allowing the delivery of the mixture of two liquids. A lipped valve is provided at the top of each take up tube to each chamber. Pumping action of the spray head combines the two liquids in a mixing chamber and ejects the mixed liquid from the spray head. A rotating cylinder is provided downstream of one of the lipped valves, the rotating cylinder having openings therein. Rotation of the cylinder allows for variation in the mixing ratio between the two liquids.

U.S. Pat. No. 3,786,963 to Metzler, III teaches a spray head assembly capable of dispensing mixed components drawn from two separate reservoirs. Two dip tubes are provided which have ball check valve prior to entry into the mixing chamber.

U.S. Pat. No. 5,152,461 to Proctor teaches yet another hand operated spray device capable of drawing fluids from two separate reservoirs. Proctor utilizes a very specialized spray head which includes threaded connections for two separate bottles. The dip tubes extend all the way to a point immediately adjacent to the spray nozzle where a diaphragm is provided which apparently serves as a flapper type check valve. Means are provided to pinch one or the other of the dip tubes to thereby vary the ratio of the liquids being drawn from the reservoirs.

Generally speaking, each of the spray heads taught in the prior art capable of drawing suction from two different reservoirs are relatively complicated requiring a redesign of the typical one fluid source spray head resulting in an overall lengthening of the spray head to allow for the inclusion of additional elements. Further, although the potential problem of syphoning created by a dual reservoir device has been recognized by Vierkötter, nothing in the prior art teaches a means for automatically preventing syphoning. Further, the present invention automatically prevents syphoning even when the device is stored in a non-vertical position.

SUMMARY OF THE INVENTION

It is therefore an object of the present invention to provide a manifold arrangement adaptable for use with an existing single reservoir spray head to allow such spray head to be used to draw simultaneously from two reservoirs.

It is a further object of the present invention to provide a manifold arrangement which prevents syphoning between the two reservoirs when the spray head and reservoirs are stored in a non-vertical position.

Yet another object of the present invention is to provide a water/concentrate dual source spray assembly which will not pump when the water supply is spent.

Briefly stated, the foregoing and numerous other objects, features and advantages of the present invention will become readily apparent upon reading of the detailed description, claims and drawings set forth herein. These objects, features and advantages are accomplished through the use of a disk-shaped manifold having upper and lower housings which interlock to form to ball check valve chambers or sockets wherein one or both of such ball check valves are spring biased. The disk-shaped manifold is designed to press fit into the intake end of a relatively typical, trigger actuated spray head such that the mixing chamber of the manifold becomes contiguous with the main flow channel through the spray head. The manifold includes an annular projection or flange which serves as a bearing surface as the spray head is screwed down onto the reservoir bottle. Actuation of the trigger on the spray head operates a positive displacement pump which draws suction through both check valves and therefore, through each of the dip tubes extending from the check valves. The spray head with the manifold of the present invention inserted therein is thus adapted to be used in conjunction with a bifurcated bottle such that two fluids can be delivered simultaneously through the single spray head.

DETAILED DESCRIPTION OF THE PREFERRED EMBODIMENT

Figure 1:
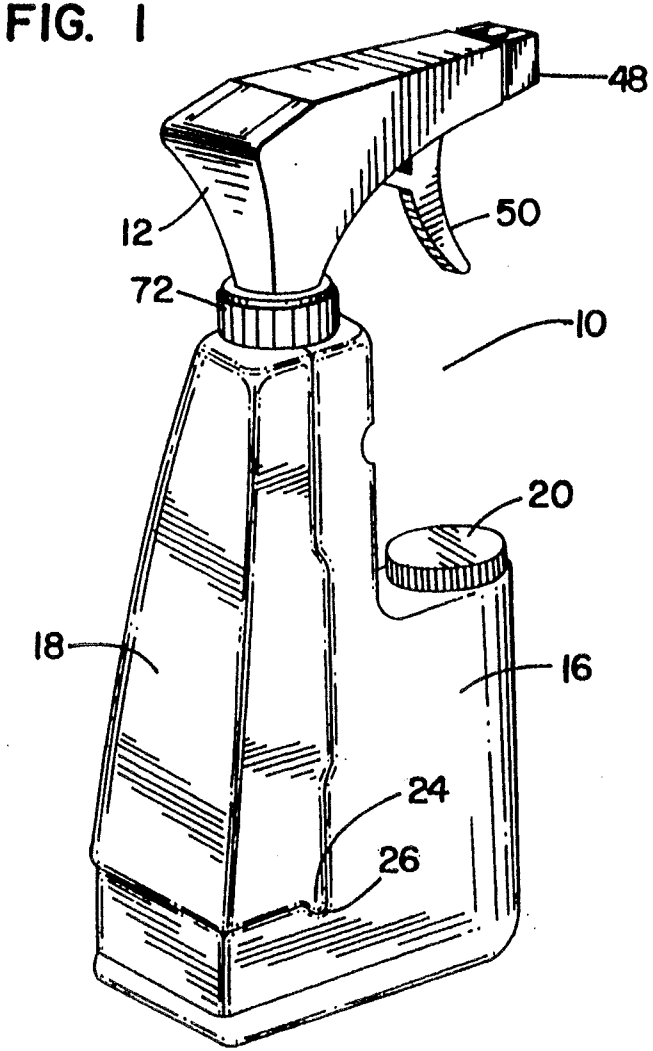
FIG. 1 is a perspective view of the dual liquid spraying device of the present invention.

Turning first to FIG. 1 there is shown the two fluid spray dispenser 10 of the present invention. The spray dispenser 10 includes a spray head 12 and a reservoir module 14. Reservoir module 14 includes a water bottle 16 and a separate but interlocking or interfitting chemical concentrate bottle 18. Water bottle 16 includes a fill cap 20 which threadably engages a nozzle. Fill cap 20 allows the water bottle 16 to be refilled without having to remove the spray head 12 from the reservoir module 14. In such manner, potential exposure to undiluted concentrate is minimized.

Water bottle 16 and concentrate bottle 18 fit together to present an overall shape or silhouette of a single bottle. Toward that end, water bottle 16 and concentrate bottle 18 are interlocked, preferably by having mating male and female surfaces 24, 26. At the top of concentrate bottle 18 is neck 28 which is semi-cylindrical. Neck 28 has an enclosed top 30 with a port therethrough from which dip tube 32 extends into the interior of concentrate bottle 18. Neck 28 also includes a threaded arcuate surface 34 and a planar surface 36.

Figure 3:
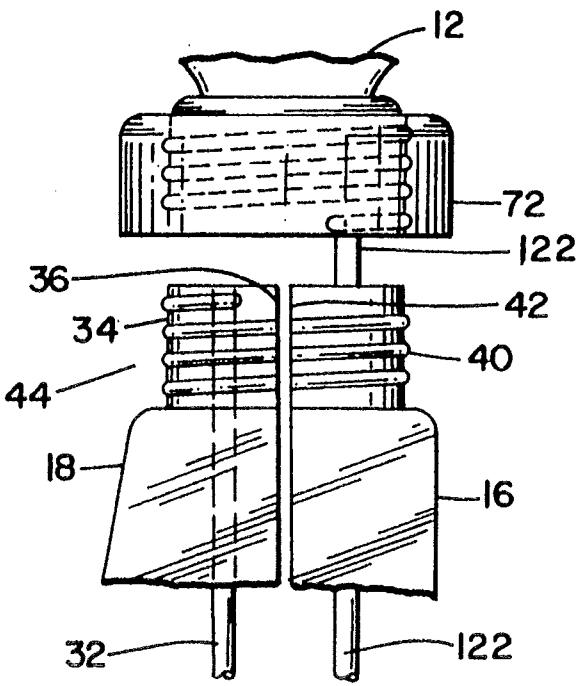
FIG. 3 is detailed elevational view of the tops of the concentrate bottle and the water bottle and the threaded collar of the spray nozzle.
Figure 2:
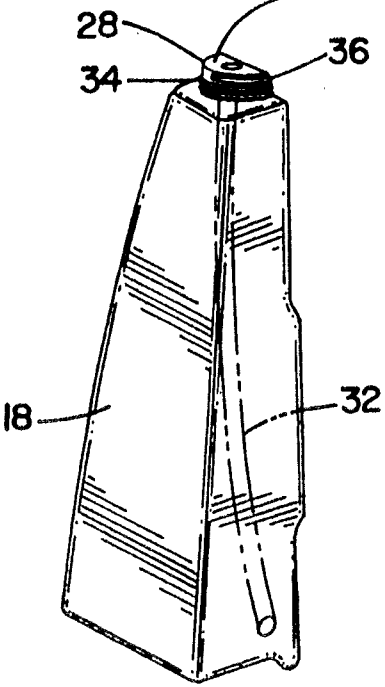
FIG. 2 is a perspective view of a concentrate bottle.

Looking next at FIG. 3, there is a semi-cylindrical neck 38 located at the top of water bottle 16. Neck 38 includes an arcuate threaded surface 40 and a planar surface 42. When concentrate bottle 18 is mated with water bottle 16 such that male surface 24 is received in female surface 26, neck 28 and neck 38 abut one another such that planar surface 36 resides adjacent to planar surface 42. In such manner, necks 28, 38 combine to form a composite cylindrical threaded nozzle 44.

Figure 4:
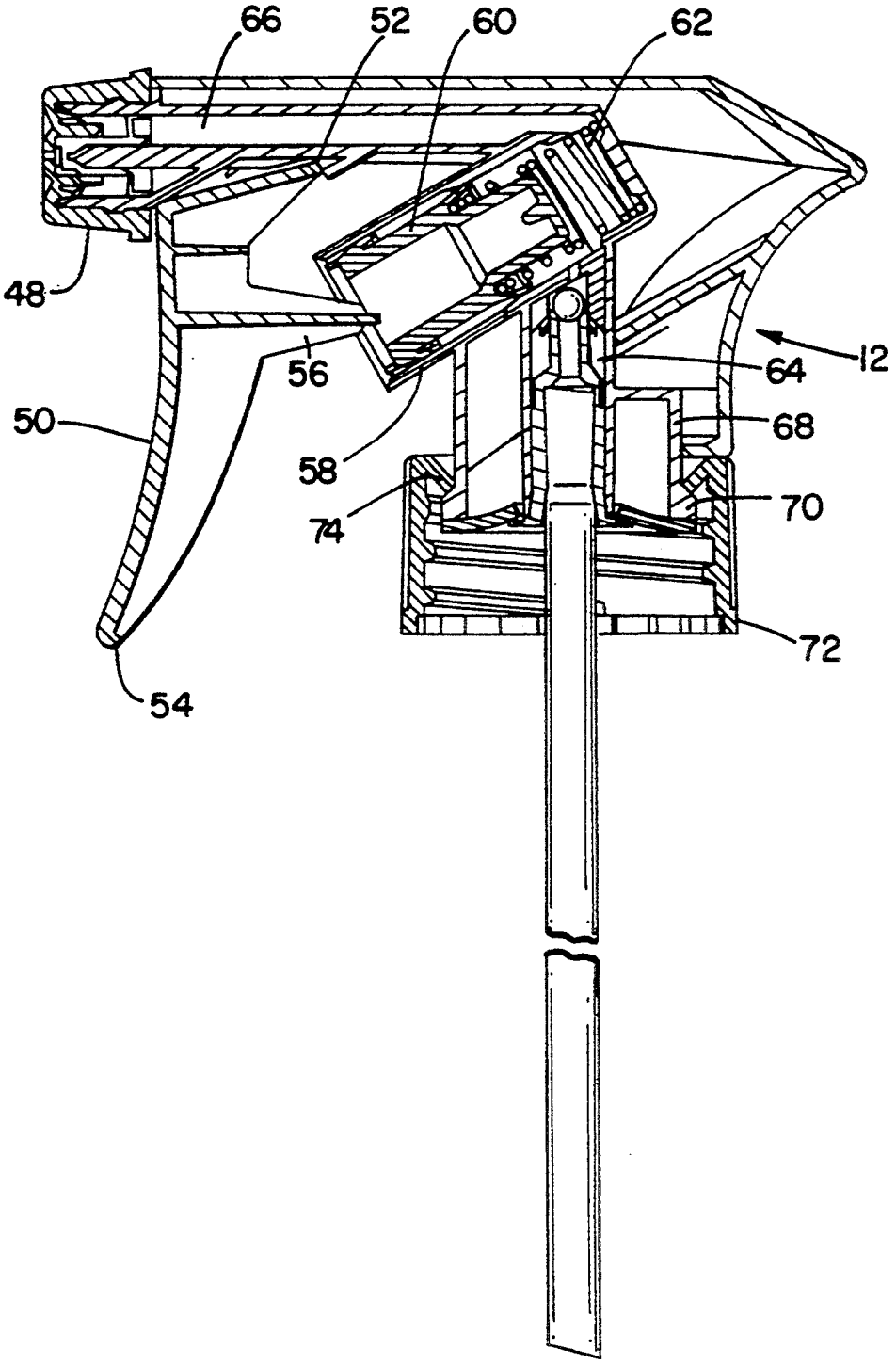
FIG. 4 is a sectional view of a prior art conventional spray head intended for use to spray liquid drawn from a single reservoir.

Looking next at FIG. 4, there is shown the spray head 12 in cross section. Spray head 12 includes a housing 46. Attached to housing 46 is spray nozzle 48. There is a trigger 50 pivotally connected to housing 46 at proximal end 52. Projecting back from trigger 50 at a point between proximal end 52 and distal end 54 is driver 56. Driver 56 extends back into cylinder 58. Residing within cylinder 58 is piston 60 which is biased toward driver 56 by means of spring 62. There is an inlet channel 64 through which fluid is delivered into cylinder 58 and there is an outlet channel 66 through which fluid is pumped from cylinder 58 to spray nozzle 48. Surrounding inlet channel 64 is throat 68 which includes an annular lip 70 at the base thereof. There is a female threaded coupling or collar 72 which includes a substantially radially inwardly projecting retaining rim 74 which retains female coupling 72 on throat 68 while allowing female coupling 72 freedom of rotation movement thereon. In such manner, female coupling 72 can be threaded onto composite cylindrical threaded nozzle 44.

Figure 5:
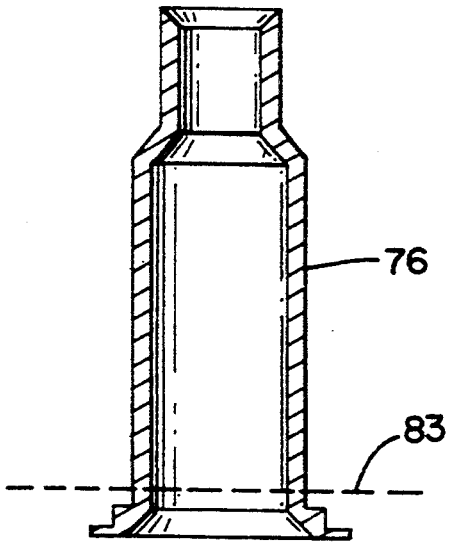
FIG. 5 is an enlarged sectional view of the sleeve shown in FIG. 4.
Figure 9:
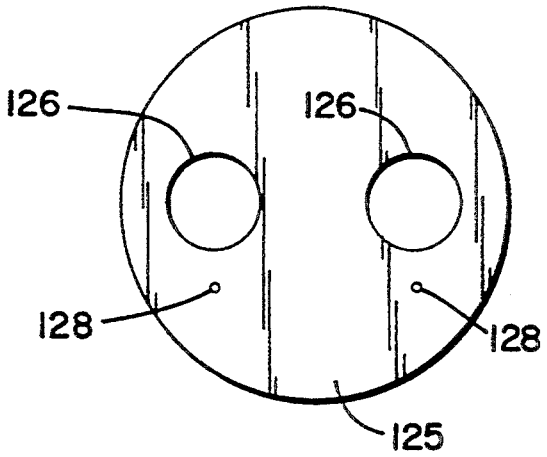
FIG. 9 is a bottom plan view of the gasket shown in FIG. 6.
Figure 6:
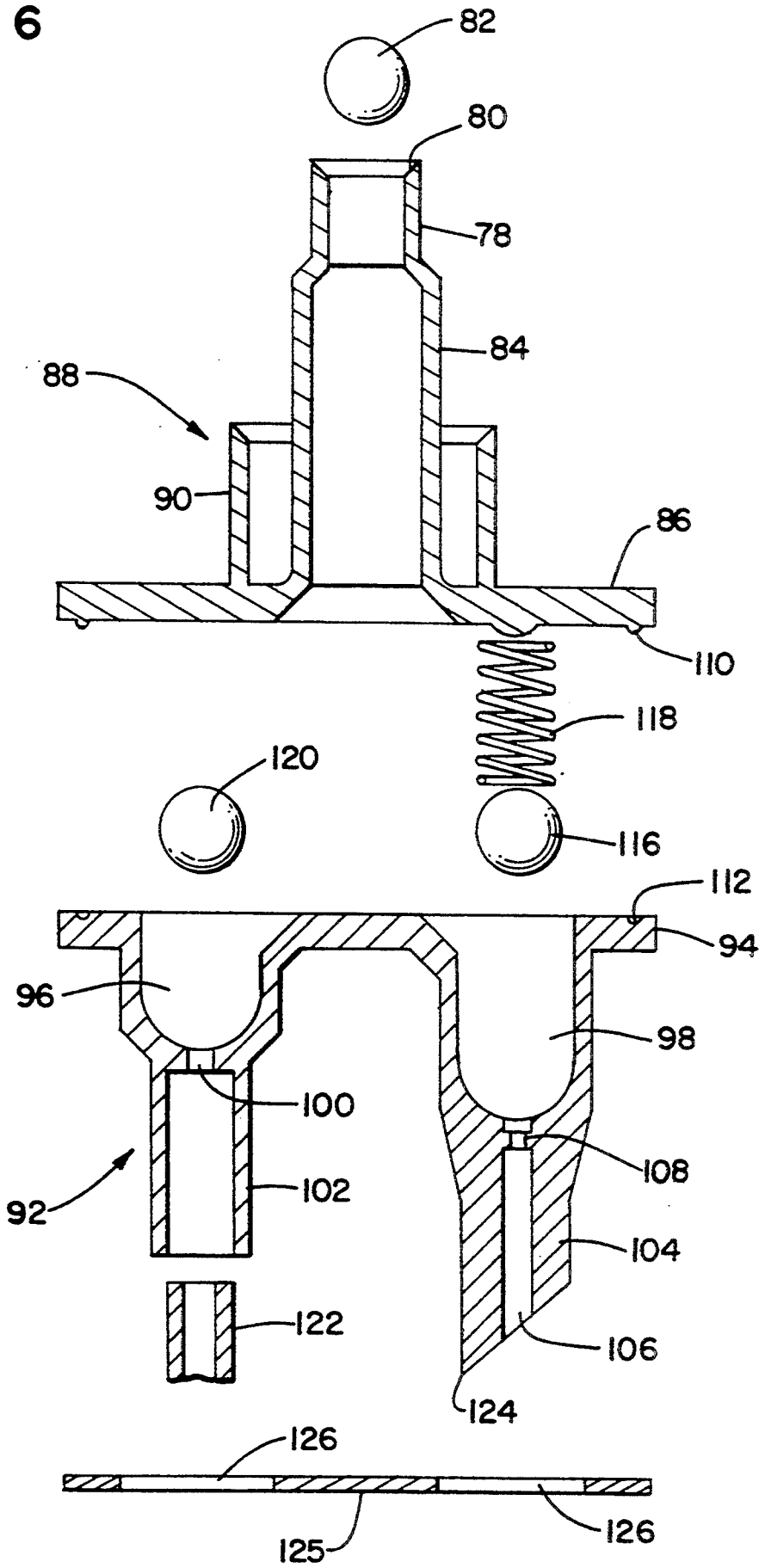
FIG. 6 is an exploded cross sectional view of the manifold of the present invention.

The spray head 12 as described thus far and shown in FIG. 4 is readily available from Calmar, Inc. of Watchung, N.J. Such spray head 12 available from Calmar also includes a sleeve 76 which press fits into throat 68. The upper end of sleeve 76 reduces to a narrow conduit 78. The distal end of narrow conduit 78 is beveled inwardly to provide residence for ball 82 yielding a ball check valve arrangement. However, as supplied in the Calmar, Inc. Model TS-800 trigger sprayer, sleeve 76 must be modified or replaced in order to practice the present invention. Although not necessary to practice the present invention, it is preferable to retain the check ball arrangement of ball 82 and narrow conduit 78. This can be accomplished through either modifying sleeve 76 to cut off and remove that portion below line 83 (See FIG. 5) or through replacing sleeve 76 with alternative sleeve 84 (See FIG. 6 and 7). Alternative sleeve 84 extends from flange 86 which becomes the upper housing of manifold 88 (See FIGS. 7, 8 and 9). Alternative sleeve 84 also includes a narrow conduit 78 which has an inwardly beveled distal end 80 to provide residence for ball 82. Alternative sleeve 84 press fits into throat 68. There is an outer cylindrical member 90 present on alternative sleeve 84 which frictionally engages the outside surface of throat 68. If the upper housing of manifold 88 is to be used in conjunction with a modified sleeve 76, then all of a substantial portion of alternative sleeve 84 can be eliminated.

Manifold 88 also includes a lower housing 92 having a flange 94. Projecting below flange 94 is a first socket 96 and a second socket 98. Sockets 96, 98 have substantially hemispherical bottoms. At the base of first socket 96 is orifice 100 which connects socket 96 to water draw stem 102. Projecting from the base of second socket 98 is chemical concentrate draw stem 104 having a cylindrical bore 106 therethrough. There is an annular projection integrally formed with chemical concentrate draw stem 104 which serves as a restriction orifice 108. Such restriction orifice 108 is sized to draw the correct amount of chemical concentrate to mix with the water so that an accurate and predetermined mixing ratio is obtained. Lower housing 92 also has vent holes 109 therethrough to ensure that the spray dispenser 10 does not become vapor locked.

There is an annular seal member 110 projecting from the bottom of flange 86 which mates with annular recess 112 in the top surface of flange 94. Upper housing or sleeve 84 is affixed to lower housing 92, preferably by means of ultrasonic welding. Also projecting from the lower base of flange 86 is spring retaining nub 114. Residing within second socket 98 is ball 116 and spring 118. Spring 118 biases ball 116 against the hemispherical bottom of socket 98 yielding a spring loaded ball check valve arrangement. Preferably there is a ball 120 residing in first socket 96 to create a ball check valve arrangement there. However, it may be possible to eliminate the ball check valve arrangement in socket 96 and still obtain the benefits of the present invention. There is a water dip tube 122 extending from water draw stem 102.

When installing the spray head 12 on the reservoir module 14, water dip tube 122 is inserted into the opening at the top of neck 38. Chemical concentrate draw stem 104 is then aligned with the opening at the top of dip tube 32. Chemical concentrate draw stem 104 forms a friction fit with the inner cylindrical wall dip tube 32 such that there is sealing engagement therebetween. There is a gasket 125 positioned beneath flage 94 which provides a seal between manifold 88 and composite nozzle 44. Gasket 125 includes bores 126 through which dip legs 102, 104 insert, and vent holes 128 which align with vent holes 109. (See FIG. 8).

Figure 7:
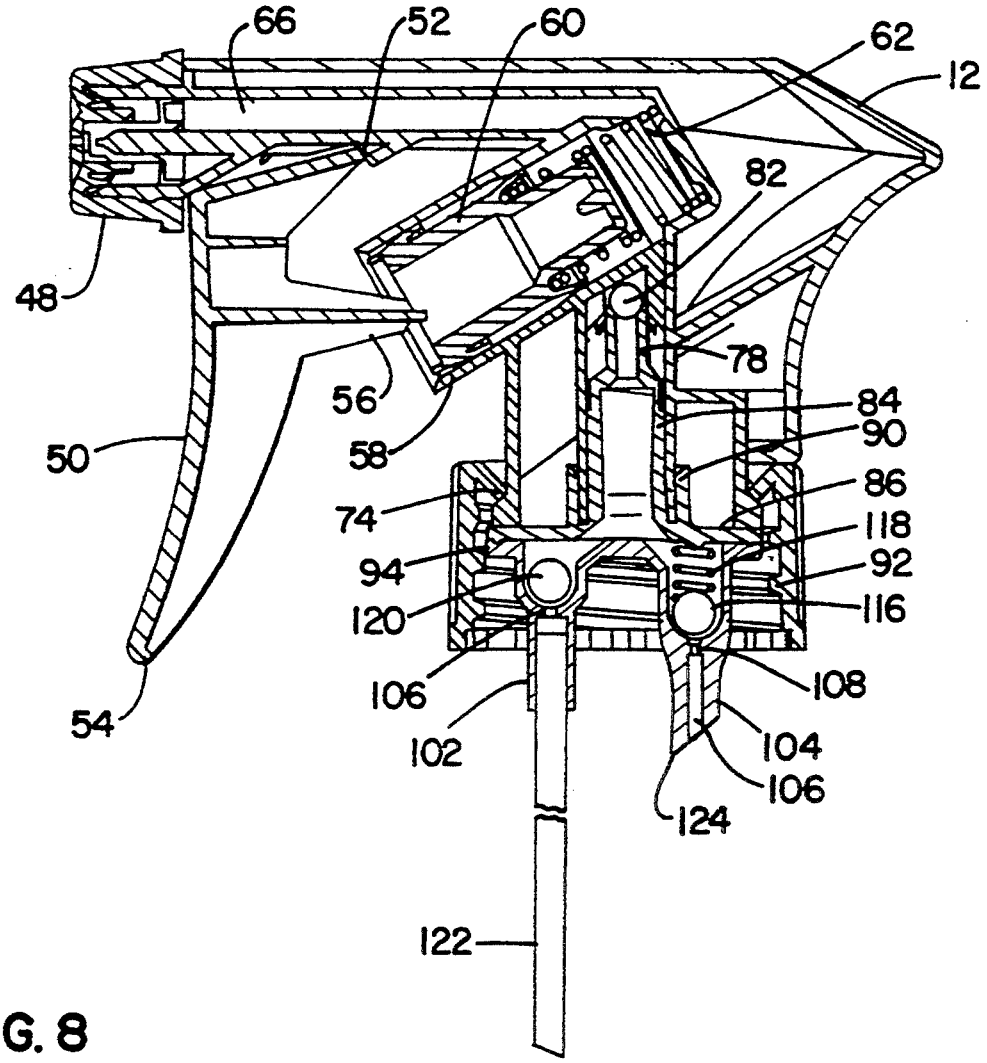
FIG. 7 is a cross sectional view of the spray head with the manifold of the present invention installed therein.
Figure 8:
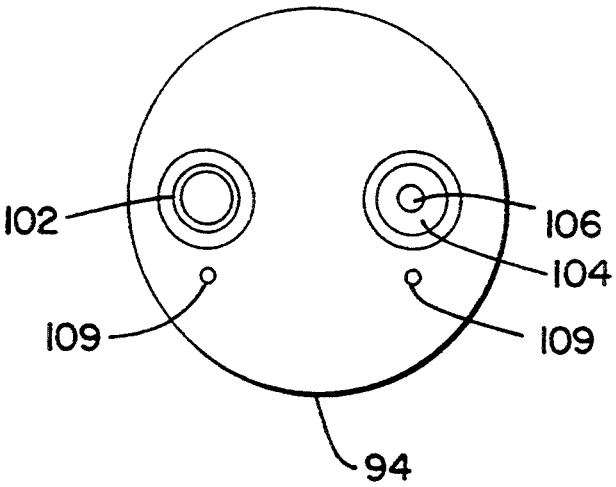
FIG. 8 is a bottom plan view of the manifold of the present invention.

In order to minimize exposure of an end user to the full strength chemical concentrate contained in concentrate bottle 18, the opening of dip tube 32 at enclosed top 30 may be covered with a plastic film to prevent leakage. As depicted in FIG. 7, chemical concentrate draw stem 104 may have a piercing point 124 which will pierce the sealing film covering the opening to dip tube 32. In such manner, chemical concentrate bottle 18 is opened by the act of installing the spray head onto the reservoir module 14 and not beforehand. Once the chemical concentrate draw stem 104 has been inserted down into dip tube 32, female coupling 72 can be threaded onto composite cylindrical threaded nozzle 44.

In operation, the user will aim spray nozzle 48 at the surface to be cleaned and pull trigger 50 thereby driving piston 60 against the bias of spring 62. Fluid contained with cylinder 58 is displaced by the movement of piston 60. With ball 82 seating against the distal end of narrow conduit 78, backflow into the manifold 88 is prevented. Thus, the fluid contained in cylinder 58 is displaced through outlet channel 66 to spray nozzle 48 and sprayed against the surface to be cleaned. As the trigger 50 is released, the spring 62 drives piston 60 back to its normal, at rest position. This movement of piston 60 unseats ball 82, as well as balls 116, 120, to draw water and chemical concentrate from the water bottle 16 and the concentrate bottle 18, respectively, into the inlet channel 64 and filling the cylinder 58. Cylinder 58 is thus loaded for the next actuation through the pulling of trigger 50. The pulling or pumping of the trigger 50 causes the liquid from the two containers to be drawn up and mixed together in the desired ratio in the inlet chamber 64 and the cylinder 58. Orifice 100 and the restriction orifice 108 in chemical concentrate draw stem 104 are sized to obtain a particular and predetermined ratio of concentrate to diluent. The manifold arrangement of the present invention allows this to be done with relatively consistent accuracy. Normally the orifices would be sized so as to fix the dilution ratio somewhere from about three (3) to about eleven (11) parts water to one part water meaning that the water bottle 16 must be refilled through fill cap 20 several times before the concentrate within concentrate bottle 18 is spent. Spring 118 adds to the accuracy and consistency of the dilution rate by providing a minimum cracking pressure which must be overcome before ball 116 is unseated allowing concentrate to be drawn into socket 98. The sizing of the orifices 100, 108 to obtain the desired mixing ratio will be known to those skilled in the art. The following are examples of actual sizes and dilution rates.

The following two examples are intended only to show specific orifice sizes and spring constants for the specific ratios stated.

EXAMPLE 1

Desired dilution ration: 8.5 parts water to 1 part concentrate

Liquids:

1. Water
2. Concentrate—viscosity: approximately 1 cps

| Orifice openings | |
|---|---|
| Water inlet (100) | 0.125" |
| Concentrate inlet (108) | 0.025" |
| Spring constant | 0.688 lbs/inch of deflection |
| Dip tube inside diameters | 0.090" |

EXAMPLE 2

Desired dilution ration: 11 parts water to 1 part concentrate

Liquids:

1. Water
2. Concentrate—viscosity: approximately 8 cps

| Orifice Openings | |
|---|---|
| Water inlet (100) | 0.125" |
| Concentrate inlet (108) | 0.021" |
| Spring constant | 0.688 lbs/inch of deflection |
| Dip tube inside diameters | 0.090" |

As mentioned above, the spring 118 provides a minimum cracking pressure to unseat ball 116 thereby enhancing the accuracy and consistency of the dilution rate of manifold 88. Spring 118 also overcomes the problem of syphoning of the chemical concentrate from concentrate bottle 18 across manifold 88 and into water bottle 16. Syphoning can occur when the static head (liquid level plus vapor pressure) in concentrate bottle 18 is greater than the static head within water bottle 16, or vice versa. With the present invention, syphoning pressure will never be great enough to unseat ball 116 to allow concentrate to flow into socket 98. This is true even if the dispenser 10 of the present invention is laid on its side. Because, the preferably spring constant of spring 118 is preferably sized such that it will not unseat when the dispenser 10 is stored in a non-vertical position. Further, the prevention of syphoning is automatic. The user need not take some manual shut-off step when storing the device to prevent syphoning.

Spring 118 also yields a significant safety benefit to the manifold 88 of the present invention. If water bottle 16 is emptied, actuation of the trigger 50 will not generate enough suction to unseat ball 116. Rather, only air will be pumped from water bottle 16. Because of this, concentrate alone cannot be sprayed with manifold 88. This is important in that the concentrate is intended to be used in a diluted form and, if sprayed in a concentrated form, it may be hazardous to the user, or to the surfaces on which it is sprayed, or to both.

Another advantage of the manifold draw stem/dip tube arrangement of the present invention is that the user cannot inadvertently reverse the position of the manifold 88 with respect to the bottles 16, 18. A user will not be able to install spray head 12 onto composite cylindrical threaded nozzle 44 in such a manner that water dip tube 122 inserts into concentrate bottle 18. The only opening into concentrate bottle 18 is through dip tube 32 and since dip tube 32 is preferably with the same diameter as dip tube 122, one can not be inserted through the other. This is important in that the orifices 100, 108 are sized for a specific and predetermined ratio which ratio would be essentially reversed if the user was to inadvertently install the spray head 12 such that water was drawn on through second socket 98 and chemical concentrate was drawn through first socket 96.

Although the valves of manifold 88 are described herein as being ball check valves, it will be recognized by those skilled in the art that other types of check valves can be used as well, such as flapper type check valves. In the case of the check valve arrangement used in second socket 98, such alternative check valve arrangement would, of course, have to be biased to a normally closed position with the bias being strong enough to obviate syphoning.

Figure 10:
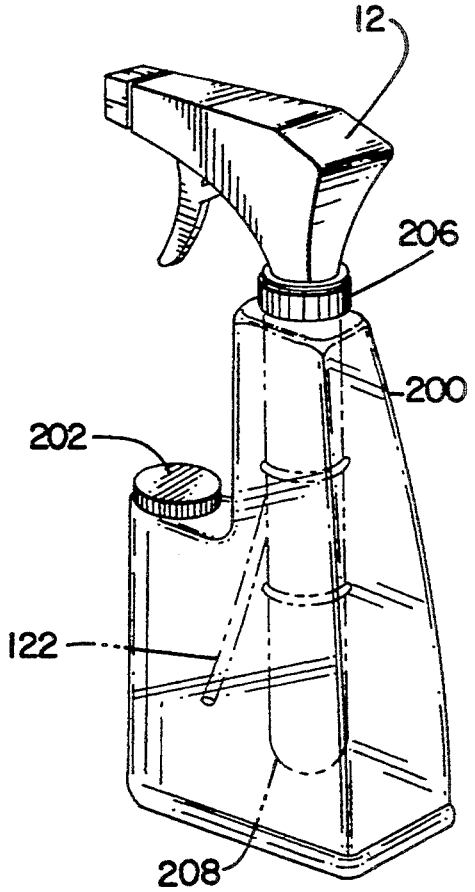
FIG. 10 is a perspective view of the dual liquid spraying device of the present invention with an alternative bottle arrangement.
Figure 11:
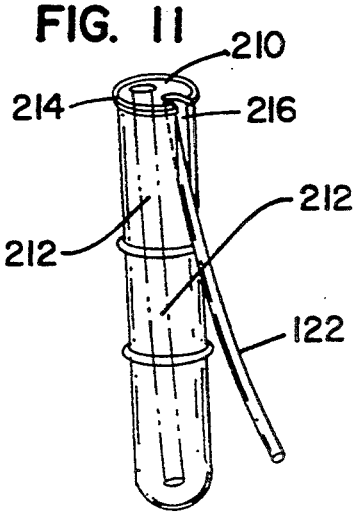
FIG. 11 is a perspective view of the chemical concentrate bottle to be used in conjunction with the alternative bottle arrangement depicted in FIG. 10.

An alternative bottle configuration for use with the spray head 12 of the present invention is depicted in FIGS. 10 and 11. The alternative bottle configuration includes a water bottle 200. There is a fill cap 202 which threads onto a nozzle allowing the user to refill water bottle 200 without having to remove the spray head 12. At the top of water bottle 200 is the second threaded nozzle 206 to which spray head above is attached. Spray head 12 is the same spray head 12 described in connection with FIGS. 1 through 9 and has the same manifold 88 installed therein. Residing within water bottle 200 is concentrate bottle 208 which has an enclosed top 210 with a port therethrough. Affixed to enclosed top 210 and extending therefrom into concentrate bottle 208 is dip tube 212. The top of dip tube 212 may be covered with a plastic film or other means preventing leakage of the chemical concentrate from concentrate bottle 208 until concentrate bottle 208 is installed within water bottle 200. Concentrate bottle 208 further includes a lip 214 having a diameter greater than the diameter of the opening through nozzle 204. In such manner, concentrate bottle 208 is supported from nozzle 204 and hangs down into water bottle 200. There is channel 216 through enclosed top 210 and into a portion of the sidewall 216 of concentrate bottle 208. Channel 216 allows the water dip tube 122 extending from water draw stem 102 of manifold 88 to pass through the opening of nozzle 204 and past enclosed top 210 such that water dip tube 122 draws from the reservoir water contained in water bottle 200.

Figure 12:
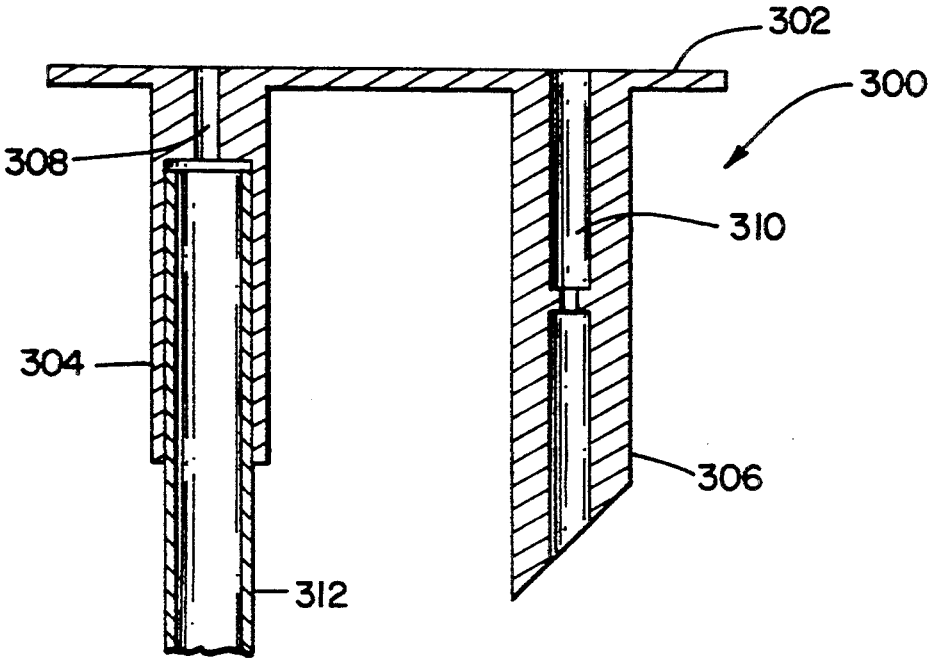
FIG. 12 is a cross sectional view of an alternative embodiment manifold.
Figure 13:
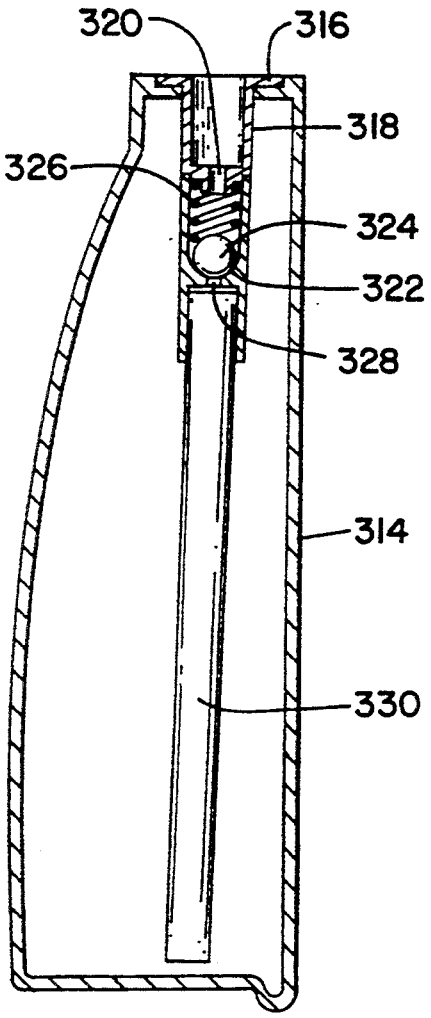
FIG. 13 is a cross sectional view of alternative chemical concentrate bottle to be used in conjunction with the alternative manifold depicted in FIG. 12.

FIGS. 12 and 13 show an alternative embodiment of the manifold and concentrate bottle of the present invention. The alternative manifold 300 includes a disk shaped member 302 having a water draw stem 304 and a concentrate draw stem 306 extending therefrom, having bores 308, 310 there through, respectively. Affixed to water draw stem 304 is water dip tube 312. Note that sockets for residence of ball check valve arrangements are not provided in alternative manifold 300, although one may optionally be provided between disk-shaped member 302 and water draw stem 304. The alternative concentrate bottle 314 includes an enclosed top 316 having cylindrical leg 318 extending therefrom down into bottle 314. There is an orifice 320 at the base of cylindrical leg 318 through which liquid can pass. Affixed to the base of the cylindrical leg 318 is socket 322. Socket 322 includes a hemispherical bottom and has residing therein a ball 324 and a spring 326. There is a restriction orifice 328 through the hemispherical bottom of socket 322. Affixed to the base of socket 322 is concentrate dip tube 330. Spring 326 normally biases ball 324 against the hemispherical bottom of socket 322 to create a ball check valve arrangement. This check valve arrangement yields all of the advantages of the ball check arrangement contained within manifold 88 described above with the exception that some expense will be added to the cost of manufacture of the concentrate bottle 314. However, the cost of the alternative manifold 300 will be less than manifold 88. This alternative manifold 300 and concentrate bottle 314 arrangement also yields the advantage of a normally sealed container which, even if removed prematurely by user when the concentrate is still contained within concentrate bottle 314, will not create a potential gross exposure problem to the user of concentrate.

Although the dispenser 10 of the present invention has been discussed herein in terms of the dilution of the chemical concentrate with water, it will be recognized by those skilled in the art that the manifold 88 of the present invention can be used to mix two chemicals rather than a chemical concentrate and water.

From the foregoing, it will be seen that this invention is one well adapted to obtain all of the ends and objects hereinabove set forth together with other advantages which are apparent and which are inherent to the apparatus.

It will be understood that certain features and combinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A manifold for use with a hand-held pump spray head allowing the spray head to draw simultaneously from a first reservoir containing a chemical concentrate and a second reservoir containing a diluent at a predetermined ratio, said manifold comprising:

(a) a lower housing including a substantially disk-shaped member with a concentrate valve body socket and a diluent valve body socket projecting therefrom, each of said concentrate valve body socket and said diluent valve body socket having an open end, an inlet port and an outlet port, said outlet ports opening into a mixing chamber;

(b) an upper housing connected to said lower housing, said upper housing enclosing said open ends to form a concentrate check valve chamber and a diluent check valve chamber;

(c) a biased check valve means residing within said concentrate check valve chamber, said biased check valve means preventing the pumping of the concentrate when the second reservoir is spent.

2. A manifold for use with a hand-held pump spray head allowing the spray head to draw simultaneously from a first reservoir containing a chemical concentrate and a second reservoir containing a diluent at a predetermined ratio as recited in claim 1, said manifold further comprising:

a flange extending radially from at least one of said upper and lower housings, said flange allowing said manifold to be fixed between the spray head and a reservoir bottle.

3. A manifold for use with a hand-held pump spray head allowing the spray head to draw simultaneously from a first reservoir containing a chemical concentrate and a second reservoir containing a diluent at a predetermined ratio as recited in claim 1 further comprising:

a draw stem extending from said concentrate valve body socket, said draw stem being capable of sealingly engaging with and disengaging from a dip tube affixed to the first reservoir.

4. A manifold for use with a hand-held pump spray head allowing the spray head to draw simultaneously from a first reservoir containing a first liquid and a second reservoir containing a second liquid at a predetermined ratio, said manifold comprising:

(a) a lower housing including a substantially disk-shaped member with a first valve body socket and a second valve body socket projecting therefrom, each of said first valve body socket and said second valve body socket having an open end, an inlet port and an outlet port, said outlet ports opening into a mixing chamber;

(b) an upper housing connected to said lower housing, said upper housing enclosing said open ends to form a first ball check valve chamber and a second ball check valve chamber;

(c) a ball residing within said first ball check valve chamber;

(d) a spring within said first ball check valve chamber biasing said ball toward said inlet port of said first valve body socket, said spring biased ball preventing the pumping of the first liquid when the second reservoir is spent.

5. A hand-held pump spray device comprising:

(a) a spray head containing a trigger actuated, positive displacement-type pump, said spray head having a spray nozzle at a discharge end thereof and a female coupling at an inlet end thereof;

(b) a first reservoir bottle for containing a chemical concentrate, said first reservoir bottle having a semi-cylindrical neck with a threaded arcuate surface and a substantially planar surface, said semi-cylindrical neck also having an enclosed top with a dip tube affixed thereto and extending into said first reservoir bottle;

(c) a second reservoir bottle for containing a diluent, said second reservoir bottle having a semi-cylindrical neck with a threaded arcuate surface and a substantially planar surface, said first and second reservoir bottles interfitting with one another such that said substantially planar surface of said first reservoir bottle abuts said substantially planar surface of said second reservoir bottle, said semi-cylindrical necks forming a composite cylindrical threaded nozzle;

(d) a manifold connected to said spray head and residing within said female coupling, said manifold including a first inlet port and a first outlet port for the chemical concentrate and a second inlet port and a second outlet port for the diluent;

(e) a check valve chamber in said manifold located between said first inlet port and said first outlet port;

(f) a biased check valve means residing within said check valve chamber, said biased check valve means preventing the pumping of the concentrate when the second reservoir is spent of diluent.

6. A hand-held pump spray device as recited in claim 5 further comprising:

a first draw stem extending from said concentrate valve body socket, said draw stem being capable of sealingly engaging with and disengaging from said dip tube affixed to the first reservoir.

7. A hand-held pump spray device as recited in claim 6 further comprising:

a second draw stem extending from said manifold, said second draw stem affixed to said second inlet port and insertable by a user into said second reservoir bottle.

8. A hand-held pump spray device as recited in claim 5 further comprising:

a flange extending radially from said manifold, said flange allowing said manifold to be fixed between said spray head and said first and second reservoir bottles.

9. A hand-held, trigger actuated, positive displacement pump spray head comprising:

(a) an inlet chamber;

(b) an outlet chamber;

(c) a spray nozzle connected to said outlet chamber;

(d) a pump cylinder located between said inlet chamber and said outlet chamber;

(e) a pump piston residing within said pump cylinder;

(f) a female coupling for connecting said spray head to a multiple reservoir source;

(g) a manifold residing substantially within said female coupling, said manifold including a first inlet port and a first outlet port for a first liquid and a second inlet port and a second outlet port for a second liquid;

(h) a check valve chamber in said manifold located between said first inlet port and said first outlet port;

(i) a biased check valve means residing within said check valve chamber, said biased check valve means preventing the pumping of the concentrate when the second reservoir is spent of diluent.

10. A hand-held, trigger actuated, positive displacement pump spray head as recited in claim 9 further comprising:

a first draw stem extending from said manifold, said first draw stem being capable of sealingly engaging with and disengaging from a dip tube affixed to a first reservoir bottle.

11. A hand-held, trigger actuated, positive displacement pump spray head as recited in claim 10 further comprising:

a second draw stem extending from said manifold, said second draw stem having a second dip tube affixed thereto, said second dip tube being insertable by a user into a second reservoir bottle.

12. A hand-held pump spray device comprising:

(a) a spray head containing a trigger actuated, positive displacement-type pump, said spray head having a spray nozzle at a discharge end thereof and a female coupling at an inlet end thereof;

(b) a first reservoir bottle for containing a chemical concentrate, said first reservoir bottle having an enclosed top with a dip tube affixed thereto and extending into said first reservoir bottle;

(c) a second reservoir bottle for containing a diluent, said first and second reservoir bottles interfitting with one another such that a single cylindrical threaded nozzle is presented to which said spray head is attached;

(d) a manifold connected to said spray head and residing within said female coupling, said manifold including a first inlet port and a first outlet port for the chemical concentrate and a second inlet port and a second outlet port for the diluent;

(e) a check valve chamber in said manifold located between said first inlet port and said first outlet port;

(f) a biased check valve means residing within said check valve chamber, said biased check valve means preventing the pumping of the concentrate when the second reservoir is spent of diluent.

13. A hand-held pump spray device comprising:

(a) a spray head containing a trigger actuated, positive displacement-type pump, said spray head having a spray nozzle at a discharge end thereof and a female coupling at an inlet end thereof;

(b) a first reservoir bottle for containing a first liquid, said first reservoir bottle having an enclosed top with a leg extending therefrom into said first reservoir bottle, said leg having a dip tube affixed thereto;

(c) a second reservoir bottle for containing a second liquid, said first and second reservoir bottles interfitting with one another such that a single cylindrical threaded nozzle is presented to which said spray head is attached;

(d) a manifold connected to said spray head and residing within said female coupling, said manifold including a first inlet port and a first outlet port for the first liquid and a second inlet port and a second outlet port for the second liquid;

(e) a first draw stem extending from said first inlet port of said manifold, said first draw stem being capable of sealingly engaging with and disengaging from said leg;

(f) a check valve socket attached to said first draw stem;

(g) a biased check valve means residing within said check valve socket, said biased check valve means preventing the pumping of the first liquid when the second reservoir is spent of the second liquid.

* * * * *